United States Patent [19]

McManus

[11] 4,175,401

[45] Nov. 27, 1979

[54] REFRIGERATION SYSTEM

[76] Inventor: Raymond McManus, R.F.D. 5, Carver, Mass. 02330

[21] Appl. No.: 5,449

[22] Filed: Jan. 22, 1979

[51] Int. Cl.[2] ..... F25D 17/00

[52] U.S. Cl. ..... 62/180; 62/203; 62/412; 165/16; 236/49

[58] Field of Search ..... 62/180, 203, 332, 409, 62/412, 235; 165/16; 236/49

[56] References Cited

U.S. PATENT DOCUMENTS

| | | | |
|---|---|---|---|
| 3,946,575 | 3/1976 | Barr et al. | 62/176 |
| 3,982,583 | 9/1976 | Shavit | 165/16 |
| 4,023,947 | 5/1977 | Ferry | 62/180 |
| 4,147,038 | 4/1979 | Hoebing et al. | 62/412 |

*Primary Examiner*—Ronald C. Capossela
*Attorney, Agent, or Firm*—Richard P. Crowley

[57] ABSTRACT

An improved refrigerator system which includes a modular duct unit with control means to provide for the use of the cooler, outside, ambient air to cool a refrigerated cooler to reduce the need to operate at full capacity the normal refrigeration compressor system for the cooler.

4 Claims, 3 Drawing Figures

REFRIGERATION SYSTEM

BACKGROUND OF THE INVENTION

It is desirable to improve the efficiency of existing refrigeration systems, such as beer coolers, in order to conserve energy. One means of improving the efficiency of refrigeration systems and to conserve energy is to employ outside colder air in the environment, when the temperature of the inside refrigerator area drops below the temperature at which the area is maintained. For example, the desired temperature in a beer cooler is typically about 32° F. to 48° F. Therefore, it would be desirable to employ cold outside air within such a beer cooler when the outside air falls below 48° F.

There have been a number of systems proposed to employ ambient air as an assistant for refrigerating units, such as, for example, as described in U.S. Pat. No. 4,023,947, wherein ambient air is supplied at a controlled rate to a refrigerated enclosure, when the ambient-air temperature drops below that within the enclosure. The described system employs two separate ambient-air supply units, each independently controlled, for operation of different temperature ranges. While such a system employs the cooler ambient air, the system must operate selectively primary and secondary air-supply ducts, and, in addition, operate the refrigeration system continuously. The system is complex and does not provide for adequate control of the air moving between the outside and the interior of the refrigeration system.

A prefabricated kit for an air-conditioning duct also has been proposed (see U.S. Pat. No. 3,946,575), wherein an attachment kit is provided to a return-air duct of an air-conditioning system in a house to employ the colder outside ambient air to aid the air conditioner located within the central duct. This system requires the inclusion of a prefabricated-kit arrangement within a return or by-pass duct in existing air-conditioning systems.

Another system (see U.S. Pat. No. 3,982,583) provides for a variable volume of air by taking fresh air into a building through the air-conditioning system through a sensor for sensing the air in the system and for regulating the airflow to maintain the minimum outdoor air at a level through the use of a damper and sensing means.

It is desirable to provide for a simple, inexpensive, modular, prefabricated, versatile kit to employ efficiently the cooler ambient air to maintain and improve a refrigeration system, such as a beer cooler and the like.

SUMMARY OF THE INVENTION

My invention relates to an improved refrigeration system for utilizing cooler ambient air to conserve energy and to a modular-duct kit adapted to convert a present refrigeration system to the improved refrigeration system of my invention. In particular, my invention relates to an improved, conventional, walk-in refrigerator, enclosure or cooler, such as a beer cooler, at a temperature of about 32° F. to 48° F. and to an integral, dual-passageway duct, assembly-kit system employed with such conventional walk-in coolers to utilize colder ambient air within the refrigerated enclosure.

A conventional refrigerator enclosure, such as a walk-in-style refrigeration system, typically uses a refrigerating system which comprises a compressor, an evaporator, a condenser, a refrigerant line connecting these units and a fan which moves the refrigerated cold air into the interior of the enclosed refrigerator system. The refrigerator system is operated through a thermostatic device located within the system, so that, when the temperature rises above the designated temperature, additional cold air is introduced into the interior of the container to maintain the refrigerator at the desired thermostat-temperature level.

My integral, modular, duct system, which provides for the employment of ambient, outside, colder air in a conventional walk-in refrigerating system, comprises three interchangeable, separate, duct units: an outside duct unit; an inside duct unit; and a control duct unit. The integral assembly is composed of a dual passageway of a first passageway to provide for the passage of warm air from the interior of the refrigerated container to the outside environment, thereby removing the warm air from the refrigerator cooler, and a second passageway to provide for the passage of the ambient cooler air from the outside environment into the interior of the refrigerator system, thereby forcing out the warmer air and conserving the power required to furnish cool air by the refrigerator system. My modular, preassembled, interchangeable, duct system makes the conversion of existing systems easy and economical and is adapted to provide for additional ducting or for the use of a number of modular units employed in one system, if desired or required.

The outside duct unit provides for a dual-passageway unit which may be mounted on a roof, while the control unit provides for a dual-passageway duct unit containing a motorized damper which is responsive to an outside thermostatic device to monitor the outside ambient-air temperature to effectuate the movement of the damper between an opened and a closed position, whereby both passageways are simultaneously in an opened or a closed position, and an interior duct unit containing a fan in electrical communication with the thermostatic device and the motorized damper-control means, whereby, when the damper-control means is in an opened condition and the ambient air falls below a designated temperature, the fans are actuated to draw cooler air from the ambient environment into the closed container of the refrigerator system and to drive out warmer air through the discharge opening in the inside duct unit.

The modular duct system, in its simplest form, involves the three separate units; although, if desired, particularly for larger-size walk-in coolers, the inlet opening of the inside duct unit may be extended through one or more duct means, so that the inlet opening extends into other parts of the walk-in refrigerator system; that is, the inlet is spaced apart from the cool-air outlet, thereby providing for rapid withdrawal and distribution of the warm air. My improved refrigeration system may be automatic, with the employment of outside and inside thermostatic devices and a motorized damper, or may be semiautomatic or even manual. It is adapted particularly for walk-in-type refrigerator systems for beer coolers, wine coolers, tonic coolers or any system that requires or needs thermostatically controlled temperatures.

My improved refrigeration system, together with the integral, dual-passageway duct, assembly system, will be described for the purpose of illustration only in connection with a particular embodiment of a walk-in refrigeration system. However, it is recognized that various changes, modifications and alterations may be made in the system as described, without departing from the spirit and scope of my invention.

DESCRIPTION OF THE PREFERRED EMBODIMENTS

Figure 1:
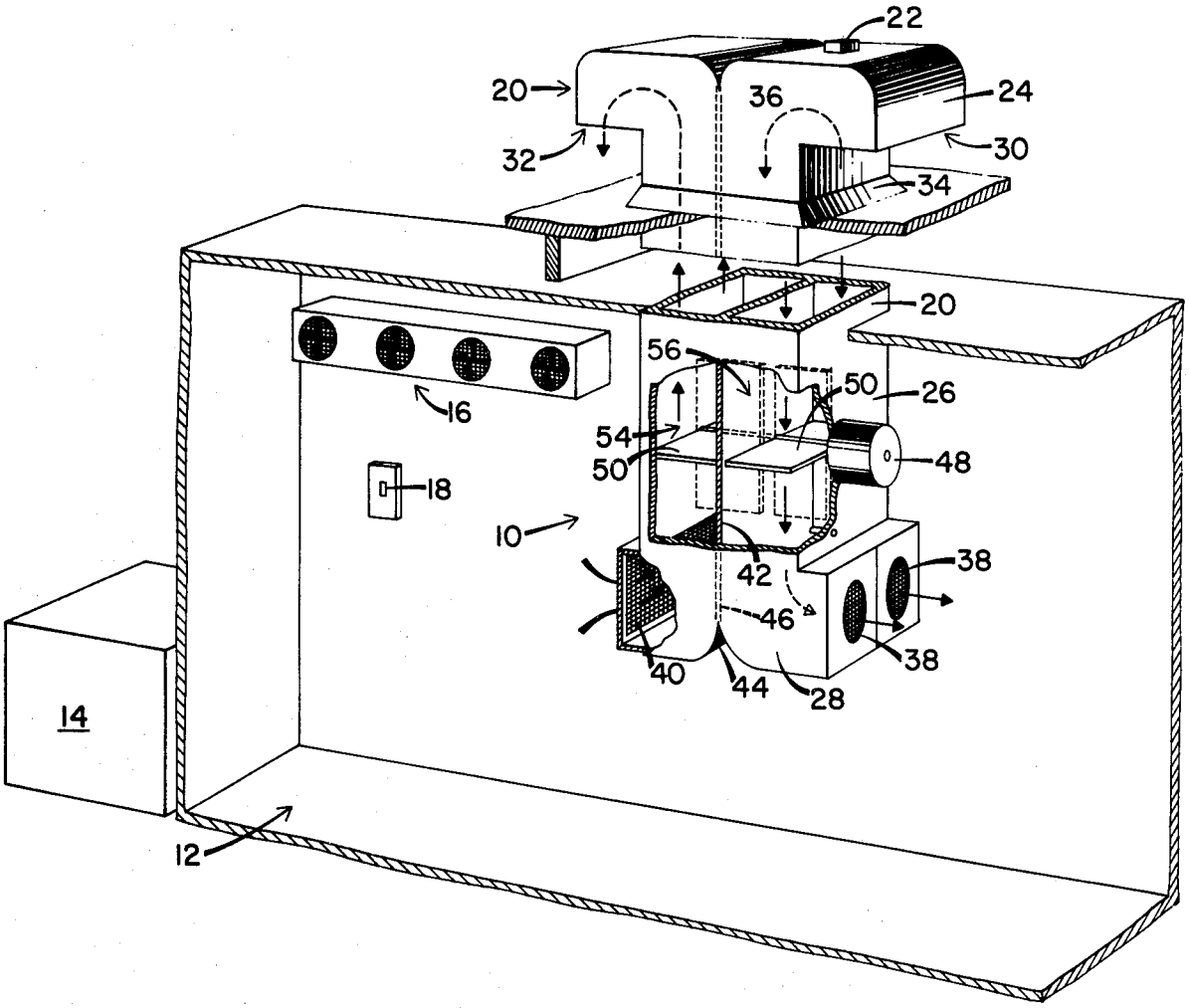
FIG. 1 is a perspective, partially cross-sectional view of an improved refrigeration system of my invention.

With reference to the drawings, there is shown an improved refrigeration system 10 which comprises a closed, walk-in, refrigeration system, such as a beer cooler 12, as a closed container, which is maintained at a desired temperature through the use of a refrigeration system which includes a compressor 14 and which provides refrigerated or cooled air to a duct system, wherein inlet fans 16 distribute the cold air from the refrigeration system compressor 14 into the closed beer cooler 12. A thermostatic, temperature-control-circuit device 18, in electrical communication with the fans 16, maintains the beer cooler 12 at the desired temperature level through actuation of the fans 16.

In the improved refrigeration system 10 as illustrated, there is shown an integral, dual-passageway duct-control modular system 20 which may include, as part of the system or as a separate device, an outside thermostatic device or temperature control 22 to monitor the temperature of the outside ambient air. The dual-passageway duct system comprises a top outside duct 24, an intervening modular-control duct 26 and an inside duct 28. The three duct units are shown in the simplest-type duct system, the modular units defining a first passageway 54 and a second passageway 56 which permit the passage of air therethrough, in accordance with my improved refrigeration system and method.

Modular duct system 20 is shown as a roof-type system which comprises a common dome roof covering the dual passageways 54 and 56 which are formed about a wall 36 in the top outside duct unit 24, to provide for an outside inlet, cold-air passageway 30 and an outlet, warm-air, inside passageway 32, which duct unit has a surrounding skirt 34 which enables the unit to fit easily over the control unit 26.

Figure 2:
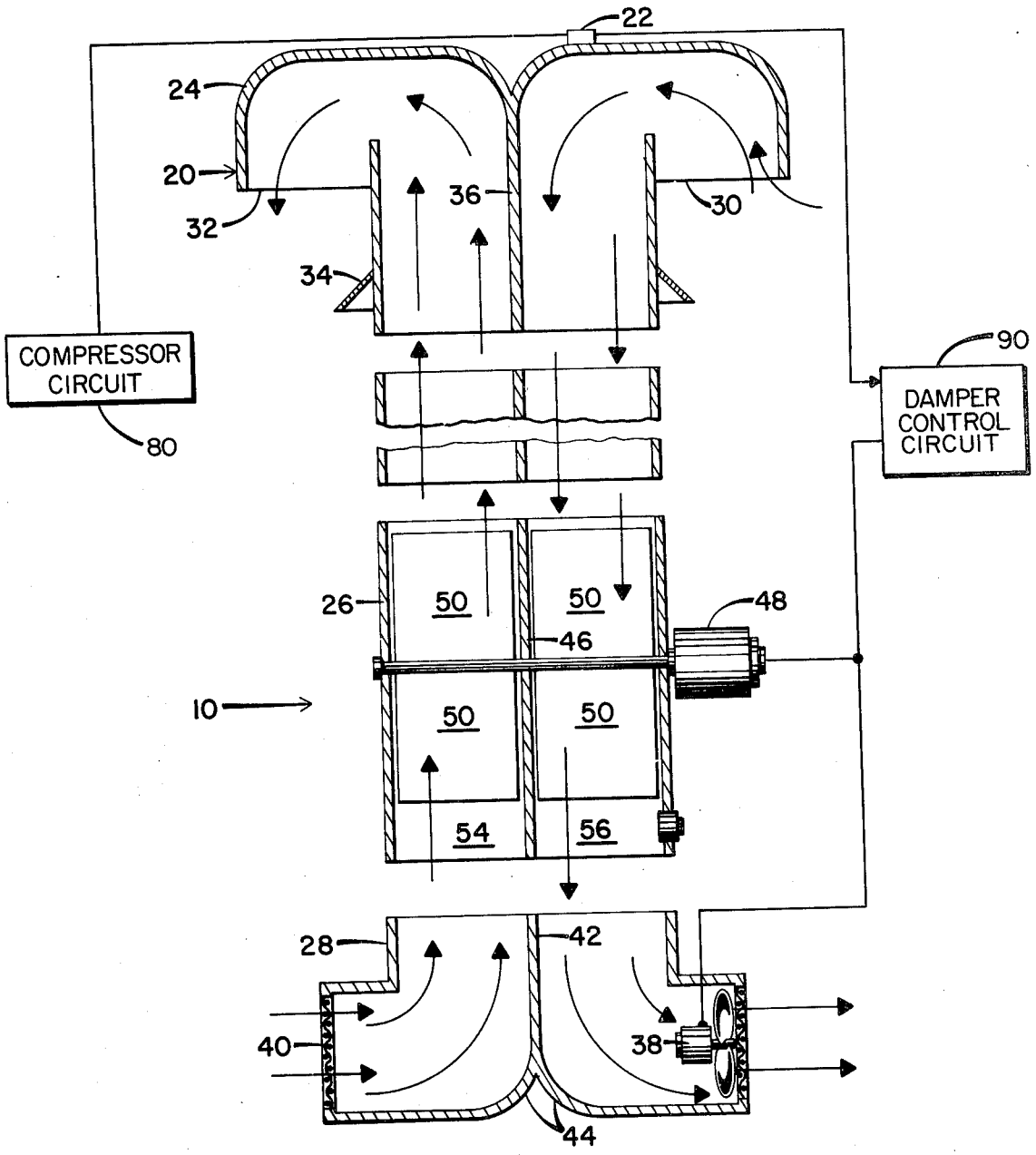
FIG. 2 is an exploded cross-sectional view of my integral, dual-passageway duct, assembly-kit system.

The modular-control duct unit 26 comprises an interior dividing wall 46 to form and continue the dual passageway and a damper 50 shown in the opened position in FIG. 2 and in the closed position in FIG. 1 and in dotted lines in the opened position. A motor 48 is used to drive the damper between the opened and the closed positions, whereby the dual passageways 54 and 56 may be closed or opened. Motor 48 is actuated by the outside thermostatic temperature control 22, which also actuates the motorized fans 38.

The inlet duct system 28 comprises an inlet-grill opening 40 to provide for the discharge of the warm air from the interior of the cooler 12 for air-balance purposes, an interior dividing wall 42 to provide for the dual passageways 54 and 56 extending through the entire modular unit, and a bottom wall 44 and motorized fans 38. The fans 38 are actuated when the ambient outside temperature drops below a preselected level and serves to draw cool air in through the damper, opened passageway 56. Where desired, the duct means may be extended, so that the inlet 40 is positioned in various other parts of the cooler, or to extend the introduction of the cooler ambient air to other parts of the cooler by fans 38. Additional dual-passageway ducts may be inserted between the three modular units 24, 26 and 28 as desired.

My system provides a simple means to convert present walk-in-type refrigeration systems to my improved system merely by cutting an introductory passage for the installation of the modular duct system 10 in the top of the cooler or the side wall of the cooler to be converted.

In operation, outside temperature-control unit 22 senses when the outside ambient air is cool enough; for example, 48° F. for a beer cooler, to be employed within the closed container 12 and shuts off the compressor 14 and fans 16. Thermostatic device 22 electrically signals the damper motor 48 through time delay switch 92 to actuate the dampers and then actuate the motorized fans 38, so that the damper swings to the opened position as shown, and fans 38 then draw in outside ambient cold air through the second passageway 56 through integral duct systems 24, 26 and 28 and discharge the cooler ambient air into the interior of the closed beer cooler 12. Warmer air or ambient air within the closed beer cooler 12 is withdrawn through and forced out through the discharge inlet 40 and the first passageway 54 and is discharged into the outside ambient atmosphere through the pressure created by the incoming cooler air froced in by the motorized fans 38.

The airflow in the improved refrigeration system is illustrated by arrows in the drawing. The airflow continues until the air within the cooler reaches the desired low temperature; for example, about 32° F. in a beer cooler, at which time the thermostatic control 98 in the cooler electrically actuates the damper motor 48 to drive the damper to a closed position (shown by the dotted lines in FIG. 1), whereby the first and second passageways are then sealed and shut off the fans 38. When the air within the cooler 12 then again warms up to about 48° F. or any desired temperature, the system then is actuated as before by providing for the walk-in beer cooler 12 to be maintained in the range of about 32° F. to 48° F. or any other desired range.

As described, when the interior of the cooler warms up to 48° F. or any desired upper temperature and provided that the ambient air outside is colder than 48° F. or the upper level, my improved refrigeration system is then actuated. My system provides for a thermostatically controlled, walk-in refrigerator running on a maximum of outside cool ambient air and for a considerable savings in energy, since, during such time, the compressor need not be used. When the outside air temperature goes above 48° F., the reverse process takes place, with the temperature control 22 actuating the compressor and the cooler fans to turn back the regular system, with the motorized dampers and fans 38 in the system actuated to close the dampers. If required and in the event that any of the termostatic controls 18, 22 and 98 fail to operate or function properly, a temperature-control alarm (not shown) can be provided to alert the user that the cooler is becoming too cool, due to outside ambient air, or too warm, due to nonoperation of the system, and corrective action then can be taken.

It has been found that effective operation of the compressor after shutdown is accomplished by the insertion of an electrically operated solenoid-control valve 84 in the refrigerant line before the expansion valve. When the compressor 14 is operating; that is, when the outside temperture is too high to actuate the temperature control 22 and intake fans 38 and to open the damper, then the solenoid valve remains open, so that there is liquid refrigerant on one side and vapor refrigerant on the other side of the expansion valve. When the compressor is inoperative and cold outside air is utilized, then the solenoid valve is closed when fans 38 are activated by control 22, so that, on one side of the expansion valve, there is some vapor, but between the closed solenoid valve and the expansion valve, there is no or little vapor. When the compressor is activated and the damper is closed and fans 38 are inactive by the rise in temperature of the outside air, then the solenoid valve is opened and liquid refrigerant is introduced into one side of the expansion valve as before, without burdening the compressor operation. Thus the use of an off/on solenoid valve, activated by the air-control thermostat 22, overcomes the overloading problems associated with compressor shutdown and startup.

My system is simply and easily controlled by an electrical control, wherein the respective inside-temperature control 18 operates as usual in commercial coolers; that is, controls the operation of the inside fans 16, when the temperature rises above or falls below designated limits. The outside-temperature control 22, by sensing the outside air temperature, activates the damper motor 48 and fans 38, to admit cold outside air, and shuts down the compressor 14 and fans 16 and closes the solenoid-compressor valve for so long as the outside air can be used in the container 12. When the outside-air temperature rises to 48° F. or higher, then the system is returned to the usual compressor refrigeration system, and the damper motor 48 is activated to shut the damper 50 and to stop fans 38.

Figure 3:
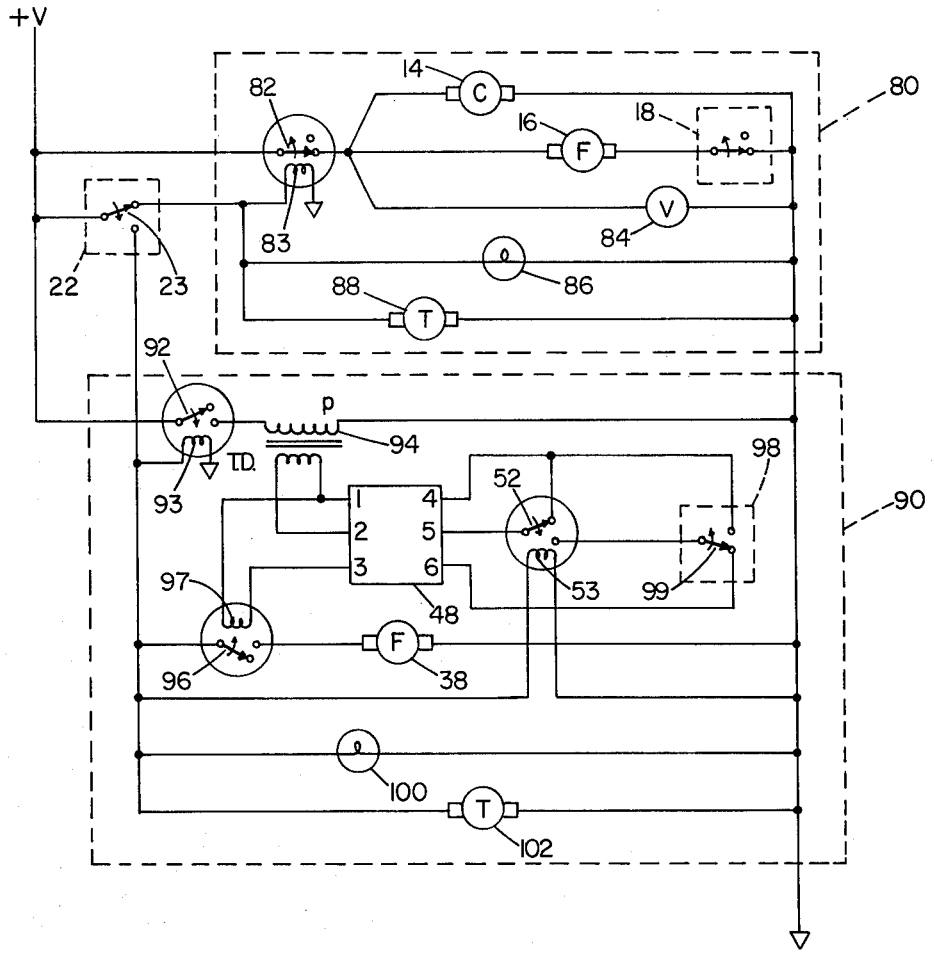
FIG. 3 is an electrical diagram of the control system used in my improved refrigeration system.

The control circuitry for the invention is shown schematically in FIG. 3. It generally comprises the outside thermostat 22, a compressor circuit 80 and a damper circuit 90.

Thermostat 22, which may be a Dalton Remote Bulb, Single Pole, Double-Throw Thermostat Model No. 2E 399, has a switch 23 whose common pole is connected to a voltage source +V. The two contacts of switch 23 are connected respectively to compressor circuit 80 and damper circuit 90 so that, depending on switch 23 position, either one circuit or the other is activated as hereinafter explained.

Compressor circuit 80 comprises a 120 V coil-controlled relay 82 whose relay activating coil 83 is connected in series between the compressor circuit contact of switch 23 and ground. If current flows through coil 83, relay 82 closes and connects the parallel combination of compressor 14, fans 16 and solenoid valve 84 to the voltage source as shown. Relay 82 may be a Potter-Brumfield Solid-State, Plug-In Relay. Fans 16 are in series with inside thermostat 18, which is a single pole thermostat of the type used in conventional coolers. A pilot light 86 and a timer 88 are connected across the relay coil 83 and the parallel combination.

Damper circuit 90 comprises a 120 V time-delay, coil-controlled relay 92 whose relay-activating coil 93 is in series between the damper circuit contact of switch 23 and ground. If current flows through coil 93, relay 92 closes and connects one side of primary winding of 110 V transformer 94 to the voltage source. The other side of primary winding is always connected to ground. Relay 92 may be a Potter-Brumfield Solid-State, Time-Delay Relay. Secondary winding of transformer 94 is connected across contact points 1 and 2 of damper motor 48, which may be a Trol-A-Temp Damper Motor Model No. 10BD. 24 V coil-controlled relay 96 is connected in series with motorized fans 38 between damper circuit contact of switch 23 and ground. Coil 97 of relay 96 is connected across damper motor contact points 1 and 3. This relay 96 may also be a Potter-Brumfield Solid-State Relay.

Damper motor 48 also has contact points 4, 5 and 6. All are connected to switch 99 of damper themostat 98, which may be of the same type of thermostat as outside thermostat 22. Damper motor contact point 4 is connected to one contact of switch 99 while contact point 6 is connected to the opposite one. The common pole of switch 99 may be connected to contact point 5 through coil-controlled relay 52, if closed. Coil 53 of relay 52 is connected between damper contact of switch 23 and ground. Relay 52 is of the same type as relay 82. When open, as shown, it connects damper motor contact points 4 and 5. Relay 52 is open when current is not flowing through coil 53. A pilot light 100 and a timer 102 are connected in parallel to coil 53.

In operation, thermostat 22 is set for a selected temperature, usually about 48° F. When the outside air temperature is above this selected temperature, the thermostat switch 23 is in the position shown in FIG. 3. Current flows through the switch 23 to the coil 83 of relay 82. Coil 83 then pulls and holds relay 82, which is normally open, into the closed position as shown. The circuit is then completed from the voltage source through relay 82, and compressor 14 and solenoid valve 84 and are turned on. If thermostat 18 senses a cooler temperature above 32° F., its switch will be closed (as shown) completing the circuit through fans 16 and turning them on also. With the initial tripping of thermostat switch 23 to the compressor circuit "on" position, pilot light 86 and timer 88 are turned on. Timer records the total amount of operating time for the compressor circuit 80, while pilot light 86 provides a visual indication of circuit operation.

When the outside temperature drops below the selected temperature, outside thermostat switch 23 trips. Current to coil 83 is cut off, and relay 82 returns to its normally open position. This cuts off current to compressor 14, fans 16 and solenoid valve 84. Current to pilot light 86 and timer 88 is cut off upon the initial tripping of switch 23. Switch 23, however, has now completed the electrical circuit from the voltage source to damper motor circuit 90. Pilot light 100 and timer 102 turn on immediately and operate in the same manner as the corresponding parts of the compressor circuit 80. Also, current flows through coil 53 so that relay 52 closes, thereby connecting damper motor contact point 5 to common pole of thermostat switch 99. Current also flows through coil 93 of time delay relay 92, but relay 92 does not trip until after a delay of about two minutes. When normally open relay 92 does trip after the delay time, one end of primary winding of transformer 94 is connected through the relay 92 to the voltage source. The current flowing through the primary induces a current in the secondary which is applied to damper motor contact points 1 and 2, which are the main input power contacts of damper motor 48. Damper motor 48 will now open damper 50 if damper motor contact points 5 and 6 are externally connected. This is the case if thermostat 98 senses a cooler temperature above 32° F., which will put thermostat switch 99 in the position shown, connecting contact point 6 to the common pole of switch 99. As previously explained, common pole of switch 99 is now connected to contact point 5 because coil 53 will be holding relay 52 closed. Damper motor 48 then rotates dampers 50 to an open position. Damper motor 48 is designed to stop automatically after damper movement is complete. After an additional time delay, usually corresponding to the time required for the damper to open, contact points 2 and 3 are internally connected by damper motor 48. Current flows through coil 97 which then closes normally open fan relay 96. This completes the circuit to fans 38 when then begin to draw the cold outside air into the cooler. This fan delay prevents the fans 38 from operating while the dampers 50 are still closed as this might cause an inward collapse of duct 26.

If the outside air should be so cold that the temperature in the cooler goes below the selected temperature of about 32° F., thermostat switch 99 trips, externally connecting damper motor contacts 4 and 5. This connection causes the damper motor 48 to rotate the dampers 50 to a closed position. Again, motor 48 automatically turns itself off after damper motion is complete. As soon as contact points 4 and 5 are connected, damper motor contact points 2 and 3 open. Current is cut off to coil 97 and relay 96 resumes its normally open condition. This breaks the circuit through fans 38 thereby turning them off.

If the inside temperature is still above 32° F., but the outside temperature then rises above 48° F., outside thermostat switch 23 changes back to its initial position and activates the compressor circuit 80. The dampers 50 are still open, however. Time delay coil 93 maintains relay 92 in a closed position for about two minutes after switch 23 has tripped back to the compressor circuit operation position. Damper motor 48 is therefore still supplied from voltage source through closed relay 92. Coil 53, however, has lost all current through it, and as it does not have a time delay, relay 52 opens thereby externally connecting damper motor contact points 4 and 5. As previously explained, this closes the dampers 50 and turns off fans 38.

What I claim is:

1. An improved refrigeration system for the use of cool ambient air in the atmosphere, which system comprises in combination:

(a) a closed refrigerator container to be maintained at a desired cool temperature;

(b) refrigeration means which includes a compressor to provide for a source of cool refrigerated air for the closed container and including fan means to introduce cool air within the closed container;

(c) an inside thermostatic-control means within the closed container to monitor the temperature within the closed container;

(d) a duct system to control the introduction of cool ambient air of the atmosphere into the closed container, which duct system comprises at least three modular duct units, the duct units in combination providing for a dual-air passageway within the duct units to provide for air communication between the interior of the closed container and the ambient air of the outside atmosphere, which dual passageway comprises (i) a first passageway having a first inlet and a first outlet to provide for the passage of warm air from the interior of the closed container into the first inlet and to the first outlet and to discharge the warm air to the environment, (ii) a second passageway having a second inlet and a second outlet to provide for the passage of cool ambient air from the atmosphere into the interior of the closed container from the second inlet to the second outlet, (iii) which duct system includes an outside duct unit placed in the ambient outside-air atmosphere and having a hooded passageway over the first outlet and second inlet, (iv) a control duct unit which comprises a damper within the control duct, the damper adapted to move between a closed position and an opened position, the opened position permitting the passage of air through the first and second passageways and the closed position preventing the passage of air through the first and second passageways, (v) an electric motor to control the position of the damper means, and (vi) an interior duct unit which comprises the first inlet and the second outlet and includes a motorized fan means in the second outlet means to draw cool ambient air from the outside atmosphere through the second inlet and to discharge cool ambient air from the outside atmosphere into the closed container;

(e) an outside thermostatic-control means to sense the temperature of the ambient air in the outside atmosphere; and (f) electrical control means in electrical communication with the inside and outside thermostatic-control means, the motor, operating the damper means, the interior fan means and the refrigeration means, including the compressor and refrigeration fans, whereby, when the ambient air in the outside atmosphere falls below a designated cool temperature, the compressor and refrigerator fans are stopped and the motor of the damper means is actuated to place the damper in an opened position and the interior fans of the interior duct unit are actuated, whereby cool ambient air from the outside atmosphere is drawn into the second inlet and is discharged from the second outlet into the closed container, and warm air within the closed container is withdrawn from the first inlet and is discharged to the outside atmosphere through the second outlet, until the temperature of the closed container reaches a desired, preselected, low temperature, at which time the first thermostatic-control means provides for the actuation of the motor for the damper to close the damper and to stop the inside fans of the inside duct unit, and, thereafter, when the closed container temperature rises above the preselected cool temperature within the closed container, another interior thermostatic device actuates the refrigerating fans, unless the ambient air in the outside atmosphere is at or below the preselected temperature, at which time the process of introducing cooler ambient air from the atmosphere is repeated, thereby maintaining a cool temperature in the closed container by the use of cooler ambient air when available.

2. The refrigeration system of claim 1 which includes an electrically operated, solenoid valve in the refrigerant line of the compressor within the container, the solenoid valve closed by the electrical control means, when the compressor is stopped and cooler ambient air is used to cool the container, and opened by the electrical control means, when the compressor is started after such stoppage.

3. The refrigeration system of claim 1 wherein the interior duct unit has a motorized fan in one wall face and an inlet for the discharge of warm air from the container in the other and opposite wall face of the duct unit.

4. A modular duct system adapted for use in the improvement of a closed refrigerator container wherein a refrigeration compressor and a refrigeration fan provide cool air to the interior of the closed container, and wherein an interior thermostatic-control device monitors and controls the interior temperature of the closed container by operation of the refrigeration fans, and a second exterior thermostatic-control device monitors the ambient-air temperature of the atmosphere outside of the closed container, the duct system comprising:

(a) an exterior duct unit adapted to be placed in the atmosphere and having first and second passageways (generally parallel) therein and having an inlet for the introduction of cool ambient air into the second passageway and an outlet for the discharge of warm air from the closed container and a hooded section covering the first inlet and first outlet;

(b) a control duct unit having first and second passageways therein aligned with the first and second passageways of the exterior duct unit and which comprises (i) a damper adapted to move between an opened and a closed position and, in the opened position, to permit the passage of air through the first and second passageways and, in the closed position, to prevent the passage of air, and (ii) a motor electrically connected to the damper to operate the damper between the opened and closed positions in response to electrical signals from the control means;

(c) an interior duct unit adapted to be placed in the closed container and having first and second passageways aligned with the first and second passageways of the exterior and control duct units, the interior unit having an inlet for the withdrawal of warm air from the closed container to the first passageway and an outlet for the discharge of cool ambient air from the second passageway into the closed container, and having a motorized fan electrically connected to the control means and adapted to operate in response to electrical signals to draw cool air into the inlet of the exterior duct unit, when the ambient-air temperature drops below a designated temperature, whereby the modular duct system permits conversion of the refrigerated closed container to admit cool ambient air; and (d) a control means in electrical communication with another thermostatic-control device to operate the damper motor and motorized fans responsive to changes in the interior and exterior temperatures.

* * * * *